US005517974A

United States Patent [19]

Akase

[11] Patent Number: 5,517,974

[45] Date of Patent: May 21, 1996

[54] FUEL INJECTION SYSTEM FOR INTERNAL COMBUSTION ENGINE

[75] Inventor: Yoshiaki Akase, Himeji, Japan

[73] Assignee: Mitsubishi Denki Kabushiki Kaisha, Tokyo, Japan

[21] Appl. No.: 402,355

[22] Filed: Mar. 13, 1995

Related U.S. Application Data

[62] Division of Ser. No. 100,922, Aug. 3, 1993, abandoned.

[30] Foreign Application Priority Data

Aug. 12, 1992 [JP] Japan ..... 4-215086

[51] Int. Cl.[6] ..... F02M 23/00

[52] U.S. Cl. ..... 123/533

[58] Field of Search ..... 123/533; 60/285

[56] References Cited

U.S. PATENT DOCUMENTS

| | | | |
|---|---|---|---|
| 4,962,745 | 10/1990 | Ohno et al. | 123/533 |
| 4,969,435 | 11/1990 | Morikawa et al. | 123/533 |
| 5,016,598 | 5/1991 | Kushibe et al. | 123/533 |
| 5,174,111 | 12/1992 | Nomura et al. | 60/285 |
| 5,205,120 | 4/1993 | Oblander et al. | 60/284 |
| 5,289,812 | 3/1994 | Trombley et al. | 123/533 |
| 5,331,939 | 7/1994 | Trombley et al. | 123/533 |
| 5,345,919 | 9/1994 | Uchinami | 123/533 |

FOREIGN PATENT DOCUMENTS

| | | | |
|---|---|---|---|
| 149541 | 10/1989 | Japan | 123/533 |

*Primary Examiner*—Raymond A. Nelli

*Attorney, Agent, or Firm*—Sughrue, Mion, Zinn, Macpeak & Seas

[57] ABSTRACT

A fuel injector air assist passage 4 bypasses the throttle valve 1 in the intake manifold of an internal combustion engine, and includes an air pump 10 itself bypassed by a further passage including a pressure controller 25. The controller has a valve disposed in the further passage, controlled by a diaphragm 25*d* having one side communicating with the intake manifold at the injector site and another, opposite side communicating with the assist passage downstream of the pump. A constant pressure differential is thereby maintained across the injector, regardless of manifold pressure changes.

2 Claims, 2 Drawing Sheets

FUEL INJECTION SYSTEM FOR INTERNAL COMBUSTION ENGINE

This is a divisional of application Ser. No. 08/100,922 filed Aug. 3, 1993, now abandoned.

BACKGROUND OF THE INVENTION

1. Field of the Invention

The present invention relates to a fuel injection system of an internal combustion engine and, more particularly, to an air-assisted fuel injection system for use in an internal combustion engine.

2. Description of the Related Art

FIG. 3 is a schematic illustration of a known air-assisted fuel injection system of an internal combustion engine such as, for example, a spark-ignited gasoline engine. The internal combustion engine, generally designated at A, has an intake pipe 15 which is provided with a throttle valve 1 for controlling the rate of supply of air to the internal combustion engine A. An air flow rate sensor 2 for sensing the flow rate of air is disposed upstream of the throttle valve 1. An air-assisted fuel injector 3 has an end confronting the internal combustion engine A and injects fuel into the engine A at a tale optimized in accordance with information given by the air flow rate sensor 2. An atmospheric air introduction passage 4 is connected at its one end to a portion of the intake pipe 15 downstream of the air flow rate sensor 2 and at its other end to the fuel injector 3. The arrangement is such that assist air is introduced through the atmospheric air introduction passage 4 due to the pressure differential between the interior of an air duct 16 of the intake pipe 15 and an intake manifold 11, so as to collide with the fuel atomized from the fuel injector 3.

In operation, the rate of supply of air into the internal combustion engine A is controlled by opening and closing the throttle valve 1. The rate of supply of the air is sensed by the air flow rate sensor 2. The air flow rate information obtained by the air flow rate sensor 2 is delivered to the computer unit 9 which sets the fuel injection rate to an optimum level. The air-assisted fuel injector 3 then injects fuel at the set fuel injection rate. Meanwhile, assist air is supplied to the fuel injector 3 through the atmospheric air introduction passage 4 due to the pressure differential between the intake manifold pressure inside the intake manifold 11 and the air pressure in the air duct 16, so as to collide with the fuel atomized from the fuel injector 3, thereby promoting atomization and micronization of the fuel.

The described known fuel injection system of internal combustion engine suffers from a problem in that the pressure differential across the air-assisted fuel injector 3 is reduced when the throttle valve 1 has been opened to a large degree i.e., when the intake manifold pressure has approached the atmospheric air pressure, so that the effect of assist air in promoting fuel atomization is reduced undesirably.

SUMMARY OF THE INVENTION

Accordingly, an object of the present invention is to provide an air injection system for an internal combustion engine, improved to ensure that assist air is always supplied at required rates under all states of operation of the internal combustion engine, thereby overcoming the above-described problems of the known art.

To this end, according to one aspect of the present invention, there is provided a fuel injection system for an internal combustion engine having an intake pipe, comprising: a throttle valve disposed in the intake pipe for controlling the flow rate of the intake air supplied into the internal combustion engine; a fuel injector having an end confronting the interior of the internal combustion engine, for injecting into the internal combustion engine at required rates; an exhaust pipe connected at its one end to the internal combustion engine and containing a catalyst for cleaning exhaust emissions; an air pump; an air pipe connected at its one end to the exhaust pipe so as to supply compressed air from the air pump to the catalyst; and an air introduction passage branching from the air pipe so as to introduce part of the pressurized air from the air pump into the fuel injector.

According to another aspect of the present invention, there is provided a fuel injection system for an internal combustion engine having an intake pipe, comprising: a throttle valve disposed in the intake pipe, for controlling the flow rate of intake air supplied to the internal combustion engine; an air-assisted fuel injector having one end confronting the interior of the internal combustion engine, for injecting a fuel into the internal combustion engine at required rates; an atmospheric air introduction passage having an inlet connected to a portion of the intake pipe upstream of the throttle valve and connected to the fuel injector so as to bypass the throttle valve; an air pump connected to the atmospheric air introduction passage, for supplying pressurized air to the fuel injector; a pressure controller disposed in a bypass passage directly interconnecting the upstream and downstream sides of the air pump, the pressure controller having a diaphragm chamber communicating with the interior of the intake manifold so as to maintain a constant air pressure differential across the fuel injector in response to changes in the intake manifold pressure; and a check valve disposed upstream of the air pump, for preventing the pressurized air from flowing backward into the intake pipe.

In the fuel injection system in accordance with the first aspect of the invention, part of pressurized air pressurized by the air pump is introduced into the fuel injector through the air introduction passage.

In the fuel injection system in accordance with the second aspect of the invention, the pressure controller operates in accordance with the changes in the intake manifold pressure, so as to maintain a constant pressure differential across the fuel injector.

The above and other objects, features and advantages of the present invention will become clear from the following description of the preferred embodiments when the same is read in conjunction with the accompanying drawings.

DESCRIPTION OF THE PREFERRED EMBODIMENTS

Figure 3:
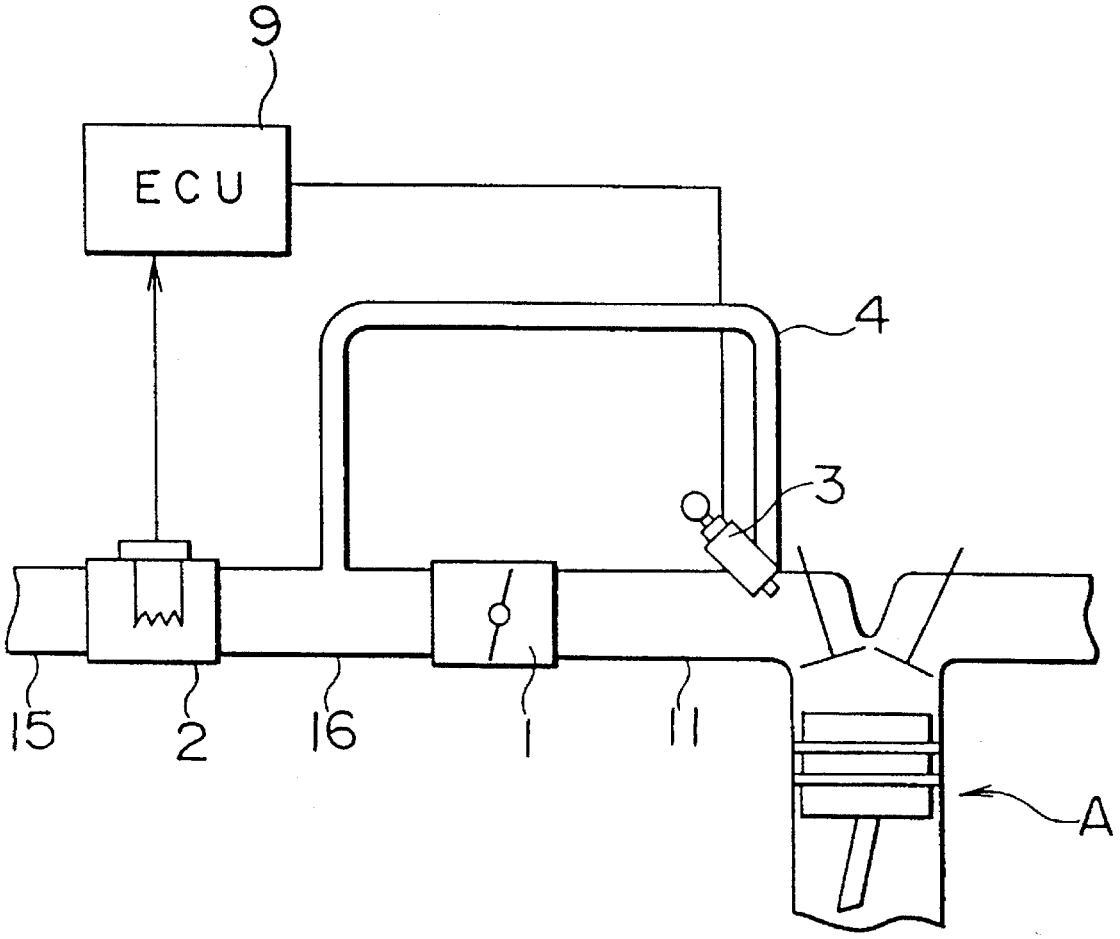
FIG. 3 PRIOR ART
FIG. 3 is a schematic illustration of a known air-assisted fuel injection system for a gasoline engine.

First Embodiment:

A first embodiment of the fuel injection system in accordance with the present invention will be described with reference to FIG. 1 in which the same reference numerals are used to denote the same or like parts or components as those appearing in FIG. 3. Detailed description of such same or like parts or components is omitted to avoid duplication of explanation.

Figure 1:
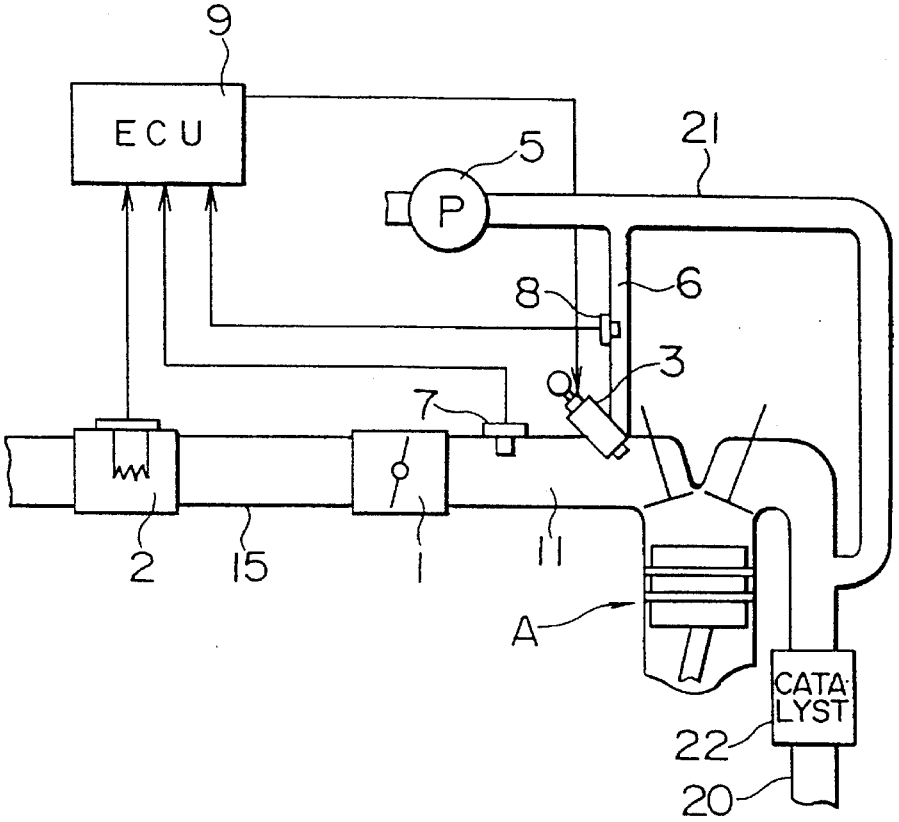
FIG. 1 is a schematic illustration of a first embodiment of the fuel injection system of the invention for a gasoline engine.

Referring to FIG. 1, an air pipe 21 is connected at its one end to an exhaust pipe 20 which contains a catalyst 22 for cleaning exhaust emissions. Part of air pressurized by an the air pump 5 is supplied as secondary air into the catalyst 22 to elevate the temperature of the latter, while the remainder of air is introduced into the fuel injector 3 through an air introduction passage 6. A boost pressure sensor 7, attached to the intake manifold, senses the pressure of the air in the intake manifold 11. A pressure sensor 8 is attached to the air introduction passage 6 so as to sense the pressure of the air upstream of the fuel injector. A computer unit 9 serves as control means which controls the fuel injection in accordance with various kinds of information such as the intake air pressure information given from the boost pressure sensor 7, air pressure information given from the air pressure sensor 8, fuel injection rate information, e.g., duty ratio or pulse width of driving pulses supplied to the fuel injector, and so forth.

In operation, intake air is introduced into the internal combustion engine at a rate controlled by the throttle valve 1. The intake air flow rate is sensed by the air flow rate sensor 2. The air-assisted fuel injector 3 injects fuel at a rate optimized on the basis of the air flow rate information given by the air flow rate sensor 2. Meanwhile, pressurized air from the air pump 5 for generating secondary air for elevating the catalyst temperature is introduced also through the air introduction passage 6 so as to impinge upon the fuel atomized from the fuel injector 3, thereby promoting atomization and micronization of the fuel. Since the air pump 5 for generating the catalyst heating secondary air is used as the source of both the secondary air and the assist air, it is not possible to measure the rate of supply of the assist air. In this embodiment, therefore, the rate of supply of the assist air is predicted based on map data set in the computer unit 9, in accordance with various information such as the results of measurements performed by the boost pressure sensor 7 and the pressure sensor 8, duty ratio or pulse width of the fuel injector driving pulse signal, and so forth. The thus predicted flow rate of the assist air is added to the result of measurement of the intake air flow rate performed by the air flow rate sensor 2 so that the fuel injection rate is controlled based on the demand air flow rate which is the sum of the flow rate of the intake air and the predicted flow rate of the assist air.

Thus, in the described embodiment of the invention, the required rate of supply of assist air is always maintained over all phases of engine operation, by virtue of the fact that the pressurized air from the air pump for generating catalyst heating secondary air is used as the assist air.

Figure 2:
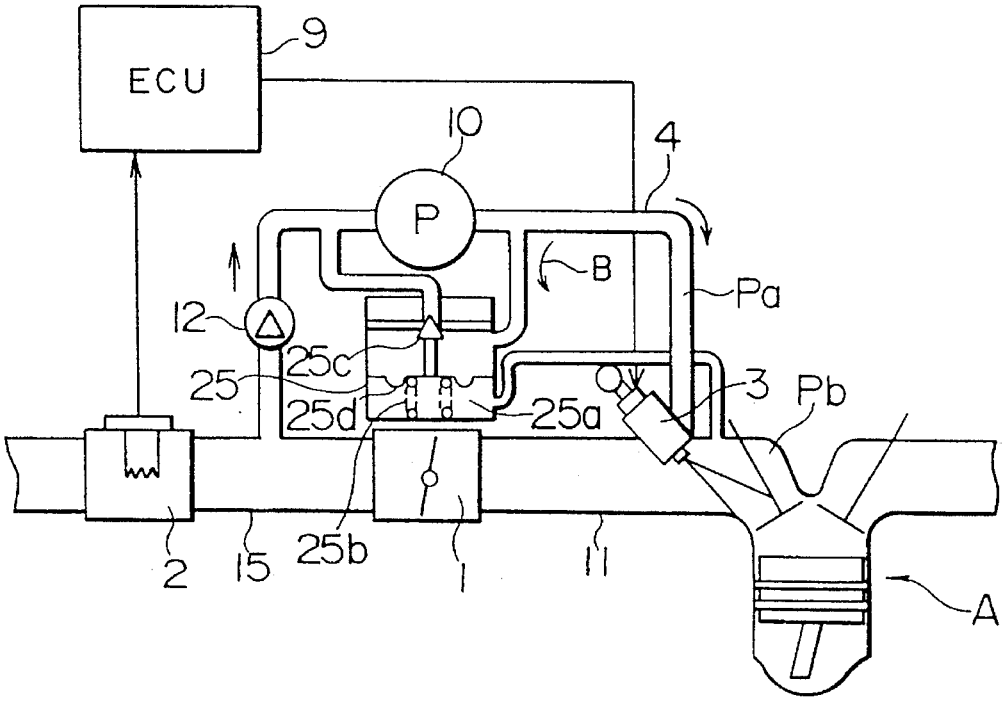
FIG. 2 is a schematic illustration of a second embodiment of the fuel injection system of the invention for a gasoline engine.

Second Embodiment:

Referring to FIG. 2 showing a second embodiment of the present invention, an air pump 10, connected to the atmospheric air introduction passage 4, generates pressurized assist air. A pressure controller 25 is disposed in a bypass passage which directly connects the upstream and downstream sides of the air pump 10. The pressure controller 25 has a diaphragm chamber **25*a* communicating with the intake manifold 11. The diaphragm 25*d* of the diaphragm chamber deflects in accordance with a change in the intake manifold pressure Pb so as to maintain a constant air pressure differential across the fuel injector 3. A check valve 12 disposed upstream of the air pump 10 prevents pressurized air from flowing backward into the intake pipe 15**.

In operation, intake air is supplied into the internal combustion engine at a rate controlled by the throttle valve 1. The flow rate of the intake air is sensed by the air flow rate sensor 2. The air-assisted fuel injector 3 injects fuel at a rate optimized on the basis of the intake air flow rate information given by the air flow rate sensor 2. Assist air introduced into the fuel injector 3 is driven by the pressure differential between the pressure Pa upstream of the fuel injector 3 generated by the air pump 10 and the intake manifold pressure Pb. The pressure controller 25 disposed in the passage bypassing the air pump 10 chamber has the diaphragm chamber **25*a* which receives the intake manifold pressure Pb transmitted from the intake manifold. The pressure controller 25 performs a mechanical control in such a manner as to maintain a constant pressure differential between the air pressure Pa upstream of the fuel injector 3 and the intake manifold pressure Pb under all states of engine operation. More specifically, when a negative pressure is established in the intake manifold 11, the negative pressure is transmitted into the diaphragm chamber 25*a* so that the diaphragm 25*d* is deflected downward as viewed the drawing against the biasing force of a spring 25*b*, so that a valve 25*c* is opened to allow pressurized air to flow in the direction of the arrow B, thereby maintaining a constant pressure differential between the air pressure Pa upstream of the fuel injector and the intake manifold pressure Pb. The check valve 12 prevents the pressurized air from flowing backward from the air pump 10 into the intake pipe 15**.

In this embodiment, a constant air pressure difference is maintained across the fuel injector under all conditions of engine operation, so that the assist air is always supplied at the required rate even when the engine is operating under heavy load, thus ensuring that the fuel injected from the fuel injector is sufficiently atomized and micronized.

What is claimed is:

1. A fuel injection system for an internal combustion engine having an intake pipe, comprising:

a) a throttle valve (1) disposed in said intake pipe, for controlling the flow rate of intake air supplied to said internal combustion engine;

b) an air-assisted fuel injector (3) having one end confronting an interior of said internal combustion engine, for injecting fuel into said internal combustion engine at required rates;

c) an atmospheric air introduction passage (4) having an inlet connected to a portion of said intake pipe upstream of said throttle valve and an outlet connected to said fuel injector so as to bypass said throttle valve;

d) an air pump (10) connected in series in said atmospheric air introduction passage, for supplying pressurized air to said fuel injector;

e) a pressure controller (25) disposed in a bypass passage directly interconnecting upstream and downstream sides of said air pump, said pressure controller having a first diaphragm chamber (**25*a*) communicating with an interior of the intake pipe downstream of the throttle valve so as to maintain a constant air pressure differential across said fuel injector in response to a change in the intake pipe pressure; and f) a check valve (12**) disposed upstream of said air pump, for preventing pressurized air from flowing backward into said intake pipe.

2. A fuel injection system according to claim 1, wherein the pressure controller comprises a valve (25*c*) disposed in said bypass passage, and controlled by a diaphragm (25*d*) defining said first diaphragm chamber, and a second diaphragm chamber communicating with the downstream side of the air pump via the bypass passage.

* * * * *